United States Patent [19]

Ocello et al.

[11] Patent Number: 4,898,411

[45] Date of Patent: Feb. 6, 1990

[54] PORTABLE DOOR LOCK

[75] Inventors: Dennis M. Ocello, Affton; Harry L. Taylor, St. Louis, both of Mo.

[73] Assignee: Ocello Tool & Die Co., Fenton, Mo.

[21] Appl. No.: 224,462

[22] Filed: Jul. 26, 1988

[51] Int. Cl.[4] ..... E05C 17/36

[52] U.S. Cl. ..... 292/292

[58] Field of Search ..... 292/244, 292, 264, 268, 292/302, 281, 284, 293–297

[56] References Cited

U.S. PATENT DOCUMENTS

| | | | |
|---|---|---|---|
| Re. 28,893 | 7/1976 | Adkison, Jr. | 292/292 |
| 118,942 | 9/1871 | Howard | 292/292 |
| 663,036 | 12/1900 | Mitchell . | |
| 724,686 | 4/1903 | Fleeger . | |
| 794,400 | 7/1905 | Farrell . | |
| 866,548 | 9/1907 | Wilkinson . | |
| 939,785 | 11/1909 | Auger . | |
| 965,913 | 8/1910 | Langstrom . | |
| 1,065,636 | 6/1913 | Tadini . | |
| 1,074,261 | 9/1912 | Hughes et al. . | |
| 1,128,363 | 2/1915 | Robinson . | |
| 1,166,692 | 1/1916 | Kennedy . | |
| 1,195,884 | 8/1916 | Wells | 292/269 |
| 1,412,340 | 4/1922 | Cruikshank . | |
| 1,467,057 | 9/1923 | Moglich . | |
| 1,668,983 | 5/1928 | Sherman . | |
| 1,947,773 | 6/1934 | Haviland | 292/292 |
| 2,520,742 | 8/1950 | Soref et al. | 292/281 |
| 2,804,332 | 8/1957 | Franklin | 292/294 |
| 3,161,428 | 12/1964 | Zook | 292/292 |
| 3,589,761 | 6/1971 | Lambert | 292/292 |
| 3,671,067 | 6/1972 | Wegner et al. | 292/292 |
| 3,913,962 | 10/1975 | Briggs | 292/292 |
| 3,914,965 | 10/1975 | Paxton | 292/281 X |
| 3,936,085 | 2/1976 | Long | 292/264 |
| 4,471,981 | 9/1984 | Wright | 292/292 |
| 4,603,895 | 8/1986 | Langenbahn | 292/295 |

FOREIGN PATENT DOCUMENTS

| | | | |
|---|---|---|---|
| 321918 | 6/1920 | Fed. Rep. of Germany | 292/264 |

*Primary Examiner*—Richard E. Moore

*Attorney, Agent, or Firm*—Senniger, Powers, Leavitt and Roedel .

[57] ABSTRACT

A portable door locking apparatus for use in combination with a door frame supporting a door, the frame having a latch recess for engaging a latch on an edge of the door. A planar member has an inner end adapted to be located between the door frame and the edge of the door and a free end projecting laterally from the door when the inner end is disposed between the door frame and the edge of the door. A tab projecting from the planar member is located within the latch recess to connect the planar member to the door frame so that the inner end of the planar member is located between the door frame and the edge of the door. At least one slot is located within the free end of the planar member. The slot has an edge disposed substantially parallel to the edge of the door when the planar member is connected to the door frame. A bolt having one end with a substantially, at least partially annular groove engages the edge of the slot and is adapted to be received in the slot. When the planar member is located between the door frame and the edge of the door and the planar member is connected to the door frame by the tab located in the latch recess and the groove of the bolt engages the edges of the slot, the bolt precludes opening of the door.

37 Claims, 2 Drawing Sheets

PORTABLE DOOR LOCK

FIELD OF THE INVENTION

The invention generally relates to door locks which are portable and can be used with various doors and, in particular, to a portable door locking apparatus for use in combination with a door frame assembly supporting a door and having a door jamb wherein the apparatus is located between the door and door jamb to preclude opening of the door.

BACKGROUND OF THE INVENTION

Various types of dead bolts, well known in the prior art, are used to selectively prevent opening of a door. Such dead bolts are generally affixed to a door jamb and have a slidable rod which engages the door when it is closed to prevent its opening. Alternatively, the rod may be affixed to the door and engage the door jamb to prevent opening of the door.

Portable door locks similar to dead bolts are also well known in the art, such as disclosed in U.S. Pat. Nos. 1,947,773, 3,913,962, and Re. 28,893. Portable door locks are for use in combination with a door frame assembly supporting a door and having a door jamb with a latch recess for engaging a latch on an edge of the door. For example, such portable door locks include a plate having a plurality of square apertures within which a bolt may be located. A lug on the plate is located in the latch recess and the door is closed so that the plate is located between the door jamb and the door and protrudes therefrom. The bolt is then located within one of the square apertures to preclude the door from opening (see U.S. Pat. No. 2,804,332 issued to Franklin). However, the portable door locks of the prior art, in general, are expensive to manufacture, are not adapted to accommodate various standard door thicknesses and employ bolts which do not firmly and conveniently engage the plate.

SUMMARY OF THE INVENTION

Accordingly, it is an object of this invention to provide a portable door lock which is inexpensive to manufacture and which can be used conveniently with standard size doors of various thicknesses, such as inside and outside doors.

It is another object of this invention to provide a portable door lock employing a dead bolt which positively and firmly engages a planar member which can be located between the door to be locked and its door frame thereby providing a highly secure door lock.

It is a further object of this invention to provide a portable door lock which can be quickly and conveniently installed either temporarily or permanently.

It is yet another object of this invention to provide a security deadbolt lock which is tamperproof in addition to being portable, strong and lightweight.

It is still another object of this invention to provide a portable door lock which can be used with doors hinged on their right side as well as doors hinged on their left side.

It is yet another object of this invention to provide a portable door lock which minimizes the size of the openings in the plate to be located between the door and door jamb so that the plate is rigid and provides a locking structure which is difficult to defeat by force.

The door locking apparatus according to the invention is for use in combination with a door frame supporting a door. The frame has a door jamb with a latch recess for engaging a latch on an edge of the door. The apparatus comprises a planar member having an inner end adapted to be disposed between the door frame and the edge of the door. Means connects the planar member to the door frame so that the planar member is located between the door frame and the edge of the door. The planar member has a free end, having at least one slot therein, laterally projecting from the door. The slot has a first edge disposed substantially parallel to the edge of the door when the planar member is connected to the door frame and the planar member is located between the door frame and the edge of the door. A bolt having one end with a substantially, at least partially, annular groove for engaging the edge of the slot is adapted to be received in the slot. When the planar member is located between the door frame and the edge of the door and the planar member is connected to the door frame by the means and the groove of the bolt engages the first edge of the slot, the bolt precludes opening of the door. Means may be located adjacent the slot for reinforcing the rigidity of the planar member. Means may be located at the free end of the planar member engageable with the door frame for limiting bending of the planar member caused by forcing the door against the bolt when the groove of the bolt is engaged with the slot. The bolt may comPrise an axially threaded elongate cylinder and a threaded screw having a head, the screw adapted to threadably engage said cylinder to form the annular groove between the head and the cylinder.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF PREFERRED EMBODIMENTS

Figure 1:
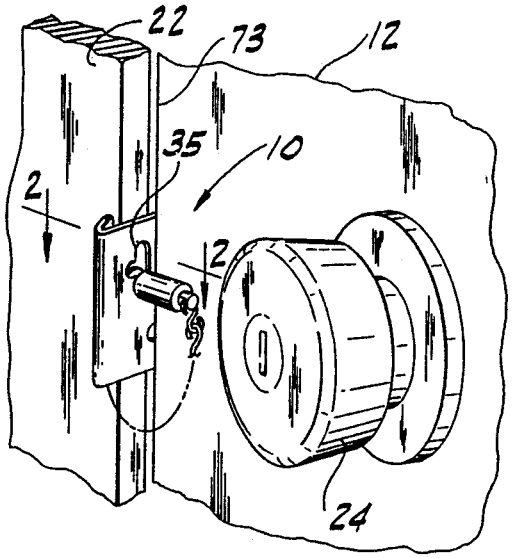
FIG. 1 is a fragmentary perspective view of a door and door frame with one embodiment of the portable door locking apparatus of the invention installed therebetween.
Figure 2:
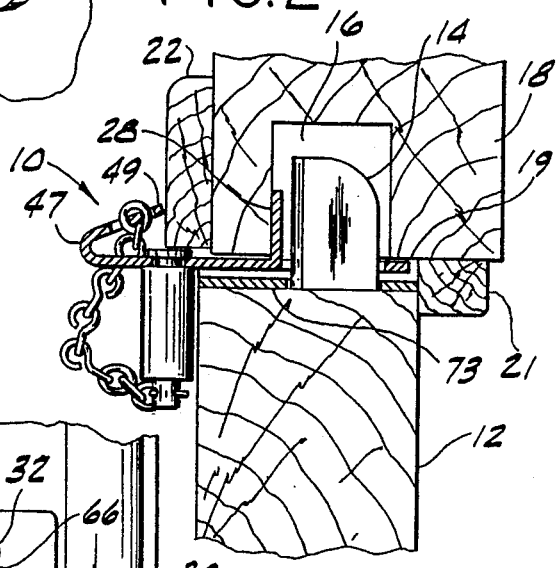
FIG. 2 is a partial, horizontal, cross sectional view taken along lines 2—2 of FIG. 1.

Referring initially to FIGS. 1 and 2, the portable locking apparatus of the present invention is designated generally by reference character 10 and is shown installed for use with door 12 having latch 14. Latch 14 is normally received in latch recess 16 in door frame 18 when door 12 is closed. Door frame 18 includes jamb 19 opposite door edge 73, door stop 21 against which door 12 is positioned when closed and a strip of molding 22 on the inside of door frame 18. Latch 14 is normally biased into its extended position, as shown in FIG. 2, by appropriate spring means (not shown) and is moved to a retracted position within the door 12 by turning door knob 24. Therefore, apparatus 10 is for use in combination with door frame 18 supporting door 12, the frame having latch recess 16 for engaging latch 14 on edge 73 of door 12.

Figure 3:
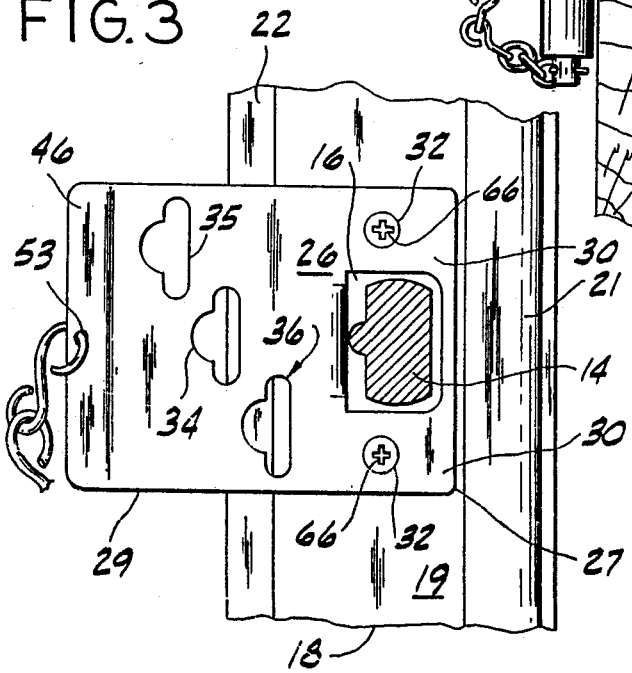
FIG. 3 is an enlarged elevational plan view of another embodiment according to the invention of a three slot planar member installed on a door frame.

As shown in FIG. 3, locking apparatus 10 includes a generally planar member 26 having inner end 27 adapted to be disposed between frame 18 having jamb 19 and edge 73 of door 12 (see FIGS. 1 and 2). Member 26 has a tab 28 projecting therefrom preferably at a right angle. Tab 28 is adapted to be received within latch recess 16 as illustrated in FIG. 2. Tab 28 constitutes means for connecting the planar member 26 to the door frame 18 so that the inner end 27 of member 26 is located between door frame 18 and edge 73 of door 12. In particular, tab 28 comprises a projection extending laterally from free end 29 of planar member 26 and adapted to be located in latch recess 16 when inner end 27 of member 26 is located between frame 18 and edge 73 of door 12. On either side of tab 28 are a pair of arms 30 which lie adjacent recess 16 when the tab is positioned within recess 16. Each arm 30 has an aperture 32 therethrough for receiving a fastener, such as screw 66, for engaging door frame 18.

Figure 4:
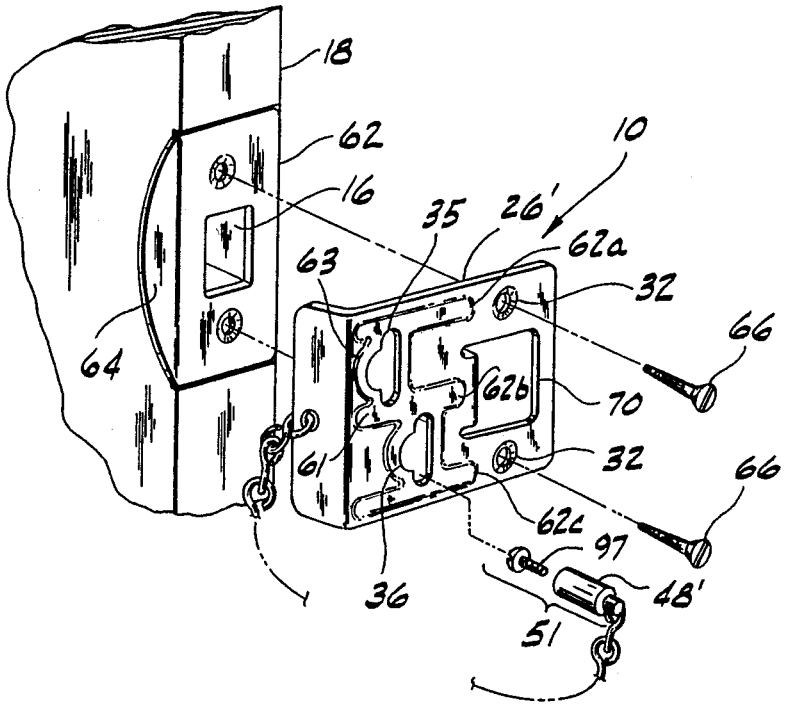
FIG. 4 is an exploded perspective view illustrating the manner in which one embodiment of the door locking apparatus of the invention including an embossed planar member replaces (or is permanently used in addition to) the striker plate normally found on the door frame.

As illustrated in FIG. 4, door frame 18 normally includes striker plate 62 positioned over latch recess 16 and having lip 64 which presents a camming surface for latch 14. Striker plate 62 is permanently secured to the frame 18 by fasteners such as screws 66. Locking apparatus 10 of the present invention may be used in place of or in addition to plate 62. When the locking apparatus 10 is to be permanently installed on door frame 18 in place of striker plate 62, screws 66 may be removed to free plate 62. Planar member 26' is then installed by positioning it in place of striker plate 62 and inserting screws 66 through apertures 32 to permanently mount member 26' to door frame 18. Alternatively, planar member 26' may be installed over striker plate 62 in which case screws 66 are removed, planar member 26' is located in registry with latch plate 62 and screws 66 are inserted through apertures 32 and the screw apertures in the locking plate to permanently mount member 26' and latch plate 62 to door frame 18.

Alternatively, locking apparatus 10 may be temporarily installed by locating inner end 27 planar member 26' over striker plate 62 so that tab 28 is located within latch recess 16. Aperture 70 is located adjacent to tab 28 for receiving latch 14. Door 12 is then closed so that latch 14 is positioned within latch recess 16 and within aperture 70 adjacent tab structure 28. It is contemplated that tab 28 may be formed by bending or punching the portion of the material of inner end 27 of planar member 26' originally located within aperture 70. Apparatus 10 need not be installed in registry with or in place of plate 62. For example, apparatus 10 may be located at any point between frame 18 and door 12. Tab 28 may be imbedded into frame 18 at any point along jamb 19 or tab 28 may be removed from plate 26' by cutting or bending or tab 28 can be bent into aperture 70 so that plate 28 can be mounted at any point along frame 18 by screws located within aperture 32 and engaging frame 18. In general, apertures 32 are within member 26 and are adapted to receive a fastener (screws 66) attached to door frame 18 thereby providing means for connecting planar member 26' to door frame 18 so that planar member 26' is located between door frame 18 and edge 73 of door 10.

At least one slot is located in free end 29 of planar member 26 in spaced relationship to tab 28. In the embodiment illustrated in FIG. 1, planar member 26 is shown with slot 35 visible, it being contemplated that free end 29 of member 26 may have additional slots between door 10 and frame 18 and, therefore, not visible. In the embodiment illustrated in FIG. 3, planar member 26 is shown with three consecutive slots 34, 35 and 36, each consecutive slot spaced a greater distance from tab 28 than the previous slot. The embodiment of FIG. 4 illustrates member 26' with two slots.

Figure 3A:
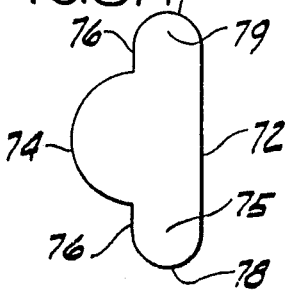
FIG. 3A is an enlarged elevational plan view of one of the slots illustrated in FIG. 3.
Figure 6:
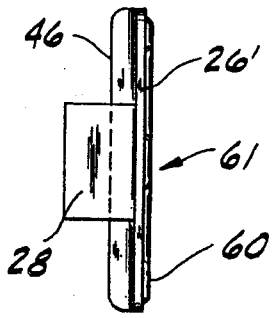
FIG. 6 is an elevational view of the inner end of one embodiment of an embossed planar member of the portable locking the invention.

As illustrated with regard to slot 36 in FIG. 3A, each slot has substantially vertical (first) edge 76 disposed substantially parallel to edge 73 of the door 12 (shown in FIG. 2) when member 26 is connected to frame 18 either by tab 28 engaging recess 16 or as illustrated in FIG. 6. Opposite edge 76, slot 36 is defined by edge 72 which is parallel to edge 76. Within edge 76 is notch 74 opposite edge 72 for receiving one end of bolt 48. Edge 72 is, therefore, located between door edge 73 and notch 74 as shown in FIG. 3. The lower ends of edges 76 and 72 are joined by lower arcuate edge 78 defining lower aperture 75. The upper ends of edges 76 and 72 are joined by upper arcuate edge 77 forming upper aperture 79. Preferably, notch 74 is centrally located between the upper and lower aperture.

To use the apparatus, head 58 of bolt 48 (shown in FIG. 5) is positioned within notch 74 and moved toward door 12 and downward so that annular groove 60 engages the edges 72 and 76 of lowermost aperture 78. Therefore, bolt 48 firmly engages two opposing parallel edges of slot 36 which are parallel to edge 73 of door 12 and the arcuate edge which joins the edges (i.e., either arcuate edge 18 for a right-hinged door or arcuate edge 77 for a left-hinged door) so that groove 60 firmly engages the planar member 26.

In FIG. 3, lip 46 presents a camming surface for latch 14 which moves the latch inwardly against the action of its biasing spring to permit the latch to clear the planar member 26. The portion of the planar member surrounding the slots 34, 35 and 36 presents a follower surface that merges into the camming surface presented by lip 46 so that latch 14 will move uninterrupted along planar member 26 with no danger of the latch 14 catching on the edges of the slots 34, 35 or 36.

Figure 5:
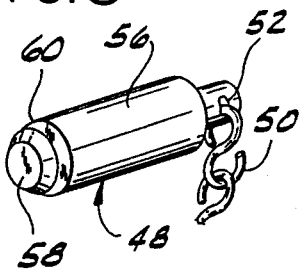
FIG. 5 is an enlarged perspective view of one embodiment of the keeper pin which functions as a dead bolt in the portable door locking apparatus of the invention.

Keeper pin 48, as illustrated in FIG. 5, is connected to planar member 26 by chain 50 which passes through an aperture 52 in one end of pin 48. The other end of chain 50 passes through aperture 53 of planar member 26 as shown in FIG. 3. KeePer pin 48 comprises an elongate cylinder bolt 56 having a rounded head 58 of slightly smaller diameter than the diameter of bolt 56. Head 58 extends axially outwardly from the end of bolt 56 and is defined by a substantially, at least partially, annular groove 60 for engaging edges 72 and 76 and either aperture 78 or aperture 79. Head 58 is adapted to be received in any of slots 34–36. When the inner end of planar member 26 is located between door jamb 20 and edge 73 of door 12 so that the projection 28 is located in the latch recess 16 and when annular groove 60 of pin 48 engages edges 72 and 76 and the arcuate edge interconnecting the edges of the slot, then bolt 48 precludes opening of door 12 as illustrated in FIGS. 1 and 2. Alternatively, as shown in FIG. 4, keeper pin 48 may comprise bolt 51' in the form of an elongate cylinder having an axially threaded aperture engaging threaded screw 97. The head of screw 97 would function in the same manner as head 58 and would define an annular groove between the head of screw 97 and axially threaded bolt 48' for engaging one of the slots. Thereafter, screw 97 could be tightened so that threaded bolt 48' would be firmly affixed to planar member 26'.

With member 26 permanently installed on the door frame 18, door 12 may be opened and closed in the usual manner without interference from locking apparatus 10. Keeper pin 48 is normally chained to member 26 and allowed to hang freely at the side of the door frame 18 when locking apparatus 10 is not in use. When door 12 is closed against door stop 21 and it is desired to lock the door, the head of keeper pin 48 is inserted into notch 74 and moved downward into aperture 78 or 79 to engage the edges of the slot.

Slots 34, 35 and 36 are symmetrical about the horizontal plane to accommodate both right-hinged and lefthinged doors and are arranged such that each consecutive slot is spaced a greater distance from tab 28 than the previous slot. When apparatus 10 is installed, the slot closest to edge 73 of door 12 is selected to engage the bolt and lock the door so that pin 48 is positioned adjacent the inner surface of door 12. Generally, interior doors are 1⅜ in thickness, exterior doors are 1¾ in thickness and security doors are 2" in thickness. Accordingly, it is contemplated that slot 36 may be located to accommodate interior doors, slot 34 may be located to accommodate exterior doors, and slot 35 may be located to accommodate security doors.

With groove 60 of pin 48 engaging edges 72 and 76 and either arcuate section 77 or 78, cylinder bolt 56 presents a positive deadbolt lock which cannot be forced, tampered with or manipulated from the outside of the door. It is to be understood that the term "deadbolt" refers to the fact that bolt 48 cannot be removed except by the positive action of a person lifting it out of its aperture and removing it from the appropriate slot which must be done from the inside of the door. The fact that head 58 is received within apertures 76 or 78 and annular groove 60 engages edges 72 and 76 and either arcuate section 77 or 78 precludes any form of jarring or vibrating action from causing bolt 48 to fall from slot 36. Gravity and friction hold bolt 48 in place within slot 58 so that only a positive force lifting bolt 48 out of slot 36 will defeat this deadbolt lock apparatus.

Referring to FIGS. 1 and 2, the folded back lip 47 constitutes means at free end 29 of planar member 26 engageable with door frame 18 for limiting the bending of planar member 26 caused by forcing door 10 against bolt 56 when the groove 60 of the bolt is engaged within a slot. In particular, folded back lip 47 on free end 29 of planar member 26 projects toward and is adapted to engage door frame 18 when the inner end of the planar member is located between door frame 18 and edge 73 of door 10. Folded back lip 47 is an integral portion of the free end of the planar member having edge 49 which faces door frame 18 so that lip 47 is substantially lateral to the inner surface 50 of molding 22 of door frame 18. In the event that excessive force is applied to door 12 when apparatus 10 is in a locked condition, such force may tend to apply a bending torque to member 26 forcing folded back lip 47 toward molding 22 until edge 49 abuts against the inner surface of molding 22. At this point, lip 47 limits further bending of member 26. Alternatively, the embodiment of FIG. 7 may also be provided with means for limiting the bending of planar member 26'. For example, projection 95 extending laterally from the surface 96 of planar member 26' which faces door frame 18 may be provided to engage door frame 18 in the event that excessive force is applied to door 12 when apparatus 10 is in a locked condition.

Figure 7:
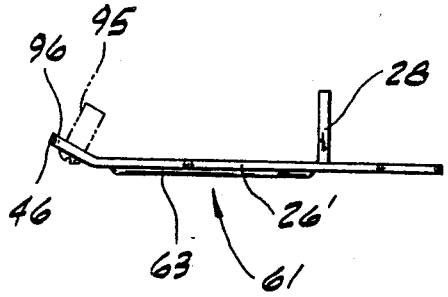
FIG. 7 is a top plan view of one embodiment of the embossed planar member of the portable door locking apparatus of the invention.

Referring now to FIGS. 4, 6, and 7, the planar member 26' includes a peripheral embossed area 61 about each slot 35, 36 for reinforcing the rigidity of the planar member 26'. The embossed area 61 comprises a planar surface 63 which is raised from, integral with and parallel to the planar member 26'. The planar surface 63 includes elongate recesses 62*a*, 62*b*, and 62*c* each having an elongate axis substantially perpendicular to the door 12 when the inner end 27 of the planar member 26' is disposed between the door frame 18 and the edge 73 of the door 12.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door locking apparatus for use with a door frame supporting a door, the frame having a latch recess for engaging a latch on an edge of the door, said apparatus comprising:

a planar member having a portion adapted to be disposed between the door frame and the edge of the door;

means for connecting the planar member to the door frame so that the planar member is located between the door frame and the edge of the door when said planar member is connected to the door frame;

the portion of said planar member having at least one slot therein having a first edge disposed substantially parallel to the edge of the door when said planar member is connected to the door frame;

a bolt having one end with a substantially, at least partially annular groove for engaging the first edge of the slot and adapted to be received in the slot whereby, when said planar member is located between the door frame and the edge of the door and the planar member is connected to the door frame by said means and the groove of the bolt engages the first edge of the slot, said bolt precludes opening of the door.

2. The apparatus of claim 1 wherein the first edge of the slot of said planar member includes a notch.

3. The apparatus of claim 2 wherein the slot has a second edge parallel to the first edge and the notch is centrally located in the first edge.

4. The apparatus of claim 3 wherein the slot in the planar member comprises a notched opening for receiving the one end of the bolt and having an upper aperture and having a lower aperture, each said aperture having substantially parallel opposing edges joined by an arcuate edge, said opposing and arcuate edges adapted to be engaged by the groove of the bolt whereby the annular groove engages the edges of the slot forming one of the apertures.

5. The apparatus of claim 4 wherein said means comprises a fastener for securement to the door frame wherein said planar member has an aperture therein adapted to receive said fastener, and wherein said bolt comprises an axially threaded elongate cylinder and a threaded screw having a head, said screw adapted to threadably engage said cylinder to form said annular groove between said head and said cylinder.

6. A portable door locking apparatus for use with a door frame assembly supporting a door and having a door jamb with a latch recess for engaging a latch on an edge of the door, said apparatus comprising:

a planar member adapted to be disposed between the door frame and the edge of the door;

a projection extending laterally from the planar member and adapted to be located in the latch recess when said planar member is located between the door frame and the edge of the door;

said planar member having at least one slot therein having a first edge disposed substantially parallel to the edge of the door when said projection is located in the latch recess and said planar member is located between the door jamb and the edge of the door;

a bolt having one end with a substantially, at least partially annular groove for engaging the first edge of the slot and adapted to be received in the slot whereby, when said planar member is located between the door jamb and the edge of the door so that said projection is located in the latch recess and the groove of the bolt engages the edge of the slot, said bolt precludes opening of the door.

7. The apparatus of claim 6 wherein the first edge of the slot of said Planar member includes, a notch.

8. The apparatus of claim 7 wherein the slot has a second edge parallel to the first edge and the notch is centrally located in the first edge.

9. The apparatus of claim 8 wherein said planar member includes a plurality of said slots, each consecutive slot spaced a greater distance from the projection than the previous slot.

10. The apparatus of claim 6 wherein the slot in the planar member comprises a notched opening for receiving the one end of the bolt and having an upper aperture and having a lower aperture, each said aperture having substantially parallel opposing edges joined by an arcuate edge, said opposing and arcuate edges adapted to be engaged by the groove of the bolt whereby the annular groove engages the edges of the slot forming one of the apertures.

11. The apparatus of claim 10 wherein the notch of said planar member is centrally located with respect to the slot so that the edge of the slot for receiving the one end of the bolt is located between the door edge and the notch.

12. The apparatus of claim 11 wherein said planar member includes at least two of said slots, a second one of said slots spaced a greater distance from the projection than the first one of said slots so that said apparatus may be used with doors of various widths.

13. The apparatus of claim 12 wherein the edges of the slots define the upper and lower apertures.

14. A door locking apparatus for use with a door frame supporting a door, the frame having a latch recess for engaging a latch on an edge of the door, said apparatus comprising:

a substantially rigid planar member having an inner end adapted to be disposed between the door frame and the edge of the door and a free end having a slot therein, said free end projecting laterally from the door when the inner end is disposed between the door frame and the edge of the door;

means located adjacent the slot and surrounding the slot for reinforcing the rigidity of the planar member;

means for connecting the planar member to the door frame so that the planar member is located between the door frame and the edge of the door when said planar member is connected to the door frame;

a bolt having one end with a substantially, at least partially annular groove for engaging a first edge of the slot and adapted to be received in the slot whereby, when the inner end of said planar member is located between the door frame and the edge of the door and the planar member is connected to the door frame by said means and the groove of the bolt engages an edge of the slot, said bolt precludes opening of the door.

15. The door locking apparatus of claim 14 wherein said means for reinforcing comprises an embossed area integral with the planar member and located about the periphery of said slot.

16. The door locking apparatus of claim 14 wherein said means for reinforcing comprises a planar surface raised from, integral with and parallel to the planar member, said slot located in said planar surface.

17. The door locking apparatus of claim 16 wherein said planar surface includes an elongate recess having an elongate axis substantially perpendicular to the door when the inner end of the planar member is disposed between the door frame and the edge of the door.

18. The door locking apparatus of claim 16 wherein said planar surface includes first and second elongate recesses parallel to each other and positioned in the embossed area, each said recess having an elongate axis substantially perpendicular to the door when the inner end of the planar member is disposed between the door frame and the edge of the door.

19. The door locking apparatus of claim 18 further comprising a second slot in the planar member having a second embossed area integral with the planar member and located about the periphery of said slot and a third longate recess parallel to the first and second recesses and positioned in the second embossed area.

20. The apparatus of claim 14 wherein said planar member has at least one slot therein having a first edge disposed substantially parallel to the edge of the door when said planar member is connected to the door frame.

21. The apparatus of claim 20 wherein the first edge of the slot of said Planar member includes a notch.

22. The apparatus of claim 21 wherein the slot has a second edge parallel to the first edge and the notch is centrally located within the first edge.

23. The apparatus of claim 22 wherein the slot in the planar member comprises a notched opening for receiving the one end of the bolt and having an upper aperture and having a lower aperture, each said aperture having substantially parallel opposing edges joined by an arcuate edge, said opposing and arcuate edges adapted to be engaged by the groove of the bolt wherebY the annular groove engages the edges of the slot forming one of the apertures 24. The apparatus of claim 23 wherein said means comprises an aperture within the planar member adapted to receive a fastener attached to the door frame.

25. A door locking apparatus for use with a door frame supporting a door, the frame having a latch recess for engaging a latch on an edge of the door, said apparatus comprising:

a substantially rigid planar member having an inner end adapted to be disposed between the door frame and the edge of the door and a free end projecting laterally from the door when the inner end is disposed between the door frame and the edge of the door, said free end having a slot therein;

means for connecting the planar member to the door frame so that the planar member is located between the door frame and the edge of the door when said planar member is connected to the door frame;

a bolt having one end with a substantially, at least partially annular groove for engaging an edge of the slot and adapted to be received in the slot whereby, when said planar member is located between the door frame and the edge of the door and the planar member is connected to the door frame by said means and the groove of the bolt engages an edge of the slot, said bolt precludes opening of the door;

means at the free end of the planar member engageable with the door frame for limiting bending of the planar member caused by forcing the door against the bolt when the groove of the bolt is engaged with the slot; and means adjacent the slot for reinforcing the rigidity of the planar member, said means for reinforcing comprising an embossed area integral with the planar member and located about the periphery of said slot.

26. The apparatus of claim 25 wherein said means for limiting comprises a lip on the edge of the free end of the member projecting toward and adapted to engage the door frame when the inner end of the planar member is located between the door frame and the edge of the door.

27. The apparatus of claim 26 wherein the door frame has an inner surface and said lip is an integral, folded back portion of the free end of the planar member having an edge which faces the door frame, said lip being substantially lateral to the inner surface of the door frame.

28. The door locking apparatus of claim 25 wherein said means for reinforcing further comprises a planar surface raised from, integral with and parallel to the planar member, said slot located in said planar surface.

29. The door locking apparatus of claim 25 wherein said planar surface includes an elongate recess having an elongate axis substantially perpendicular to the door when the inner end of the planar member is disposed between the door frame and the edge of the door.

30. The door locking apparatus of claim 29 wherein said planar surface includes first and second elongate recesses parallel to each other and positioned in the embossed area, each said recess having an elongate axis substantially perpendicular to the door when the inner end of the planar member is disposed between the door frame and the edge of the door.

31. The door locking apparatus of claim 29 further comprising a second slot in the planar member having a second embossed area integral with the planar member and located about the periphery of said second slot and a third elongate recess parallel to the first and second recesses and integral with the second embossed area.

32. The apparatus of claim 25 wherein said planar member has at least one slot therein having a first edge disposed substantially parallel to the edge of the door when said planar member is connected to the door frame.

33. The apparatus of claim 32 wherein the first edge of the slot of said planar member includes a notch.

34. The apparatus of claim 33 wherein the slot has a second edge parallel to the first edge and the notch is centrally located in the first edge.

35. The apparatus of claim 34 wherein the slot in the planar member comprises a notched opening for receiving the one end of the bolt and having an upper aperture and having a lower aperture, each said aperture having substantially parallel opposing edges joined by an arcuate edge, said opposing and arcuate edges adapted to be engaged by the groove of the bolt whereby the annular groove engages the edges of the slot forming one of the apertures.

36. The apparatus of claim 35 wherein said means for connecting comprises an aperture within the planar member adapted to receive a fastener attached to the door frame.

37. A door locking apparatus for use with a door frame supporting a door, the frame having a latch recess for engaging a latch on an edge of the door, said apparatus comprising:

a planar member having an inner end adapted to be disposed between the door frame and the edge of the door and a free end projecting laterally from the door when the inner end is disposed between the door frame and the edge of the door, said free end having a slot therein;

means for connecting the planar member to the door frame so that the planar member is located between the door frame and the edge of the door;

an axially threaded elongate cylinder and a threaded screw having a head, said screw adapted to threadably engage said cylinder to form an annular groove, said annular groove for engaging a first edge of the slot and adapted to be received in the slot whereby, when the inner end of said planar member is located between the door frame and the edge of the door and the planar member is connected to the door frame by said means and the groove of the bolt engages an edge of the slot, said bolt precludes opening of the door.

* * * * *

UNITED STATES PATENT AND TRADEMARK OFFICE

CERTIFICATE OF CORRECTION

PATENT NO. : 4,898,411

DATED : February 6, 1990

INVENTOR(S) : Dennis M. Ocello and Harry L. Taylor

It is certified that error appears in the above-identified patent and that said Letters Patent is hereby corrected as shown below:

Column 7, line 40, "said Planar", should read ---said planar---.

Column 8, line 59, "said Planar", should read ---said planar---.

Column 9, line 1, "wherebY", should read ---whereby---.

Signed and Sealed this

Third Day of September, 1991

*Attest:*

*Attesting Officer*

HARRY F. MANBECK, JR.

*Commissioner of Patents and Trademarks*